US006347948B1

(12) United States Patent
Hwang

(10) Patent No.: US 6,347,948 B1
(45) Date of Patent: Feb. 19, 2002

(54) CABLE CONNECTOR ASSEMBLY WITH IMPROVED GROUNDING MEANS

(75) Inventor: Jeng-yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/660,250

(22) Filed: Sep. 12, 2000

Related U.S. Application Data

(63) Continuation-in-part of application No. 09/574,716, filed on May 18, 2000.

(51) Int. Cl.[7] ..... H01R 13/648
(52) U.S. Cl. ..... 439/92; 439/939; 439/610
(58) Field of Search ..... 439/92, 607–610, 439/939

(56) References Cited

U.S. PATENT DOCUMENTS 4,906,201 A * 3/1990 Young et al. ..... 439/939
5,735,699 A * 4/1998 Tan et al. ..... 439/939
5,755,592 A * 5/1998 Hillbish et al. ..... 439/939
6,004,146 A * 12/1999 Tan et al. ..... 439/939
6,083,049 A * 7/2000 Kuo et al. ..... 439/939
6,113,428 A * 9/2000 Yeh ..... 439/939
6,139,367 A * 10/2000 Yeh ..... 439/939
6,168,448 B1 * 1/2001 Chang ..... 439/939
6,174,182 B1 * 1/2001 Kuo ..... 439/939

* cited by examiner

*Primary Examiner*—Gary F. Paumen
(74) *Attorney, Agent, or Firm*—Wei Te Chung

(57) ABSTRACT

A cable connector assembly (1) includes a pair of USB connectors (10), a cable end (20) electrically connecting to the pair of USB connectors, a pair of conductive latches (40) positioned at either side of the USB connectors, a cover (30) enclosing the USB connectors, and a pair of grounding bars (50, 51) positioned on outer surfaces of the cover. Each latch is V-shaped and has a first arm (42) electrically engaging with a conductive shrouded shell (12) of the corresponding USB connector, and a second arm (44) extending out from the cover to electrically and mechanically engage with a grounded panel (23) of an electronic apparatus (2) with which the cable connector mates. Each grounding bar has a base portion (52) forming a pair of spring fingers (58, 59) and a pair of conductive tabs (54, 55) extending from the base portion and electrically engaging with the conductive shrouded shells of the USB connectors. When the cable connector is mated with the electronic apparatus, the spring fingers press against the grounded panel of the electronic apparatus thereby establishing further electrical connection between the conductive shrouded shells of the USB connectors and the grounded panel of the electronic apparatus.

1 Claim, 6 Drawing Sheets

CABLE CONNECTOR ASSEMBLY WITH IMPROVED GROUNDING MEANS

CROSS-REFERENCED APPLICATION

This application is a continuation-in-part (CIP) application of U.S. patent application Ser. No. 09/574,716, filed on May 18, 2000 by the inventor.

BACKGROUND OF THE INVENTION

1. Field of the Invention

The present invention relates to a connector, and particularly to a cable connector assembly having grounding latches and grounding bars for connecting to a grounded panel mounting a mating connector on an electronic apparatus, thereby reducing EMI interference at the connection.

2. Description of the Prior Art

Generally, cable connectors are used to connect an electronic apparatus such as a personal computer to a peripheral device, such as a printer. The cable connectors are typically shielded by conductive shells to protect the electronic signals transmitted therethrough from external electromagnetic interference (EMI). The conductive shells must be grounded to a reference potential, to discharge static charge accumulated thereon and to effect the EMI protection. The conductive shells of the conventional cable connectors do not have sufficient grounding contact points to reliably connect them to a reference grounding potential, and so static charge cannot be reliably dissipated and the EMI protection is not as effective as it should be. Furthermore, a conventional cable connector does not have a device which can function both as a grounding path and as a mechanical latching means for securing the cable connector to an electronic apparatus. Therefore, an improved cable connector assembly which solves the above-mentioned problems of the prior art is desired.

BRIEF SUMMARY OF THE INVENTION

A first object of the present invention is to provide a cable connector assembly having grounding latches and grounding bars for connecting to a grounded panel of a mating electronic apparatus, thereby reducing the EMI interference on the cable connector assembly;

A second object of the present invention is to provide a cable connector assembly having conductive latches which not only ground the cable connector to a reference potential but also mechanically secure the cable connector to a mating electronic apparatus;

A third object of the present invention is to provide a cable connector assembly having one or more grounding bars for grounding the cable connector to a reference potential. Each grounding bar is formed with a pair of spring fingers. When the cable connector assembly is mated to a connector mounted on the grounded panel of the electronic apparatus, the fingers press against the panel to establish not only a firm mounting of the connector assembly to the panel but also a reliable grounding path between the grounding bar and the panel.

To fulfill the above objects, a cable connector assembly includes a pair of USB connectors, a cable end connecting to the pair of USB connectors, a pair of conductive latches positioned at either side of the USB connectors, a cover enclosing the USB connectors, and grounding bars positioned on an outer surface of the cover. Each latch is V-shaped and has a first arm electrically engaging with a shrouded shell of the corresponding USB connector, and a second arm extending out from the cover to electrically and mechanically engage with a grounded panel of an electronic apparatus with which the cable connector mates. Each grounding bar has a base portion located on the cover and a pair of conductive tabs extending from the base portion into the cover and electrically engaging with the shrouded shells of the pair of USB connectors. The base portion of each grounding bar forms a pair of spring fingers extending forwardly therefrom. When the cable connector is mated with the electronic apparatus, the pair of latches engage with the grounded panel of the electronic apparatus and free ends of the spring fingers of the grounding bar press against the panel, thereby establishing electrical connection between the shrouded shells of the USB connectors and the grounded panel of the electronic apparatus.

Other objects, advantages and novel features of the invention will become more apparent from the following detailed description of the present embodiment when taken in conjunction with the accompanying drawings.

DETAILED DESCRIPTION OF THE INVENTION

In the following detailed description, reference is made to the accompanying drawings which form a part hereof. The drawings show by way of illustration a specific embodiment in which the invention may be practiced. The embodiment is described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense. The scope of the present invention is defined by the appended claims.

Figure 1:
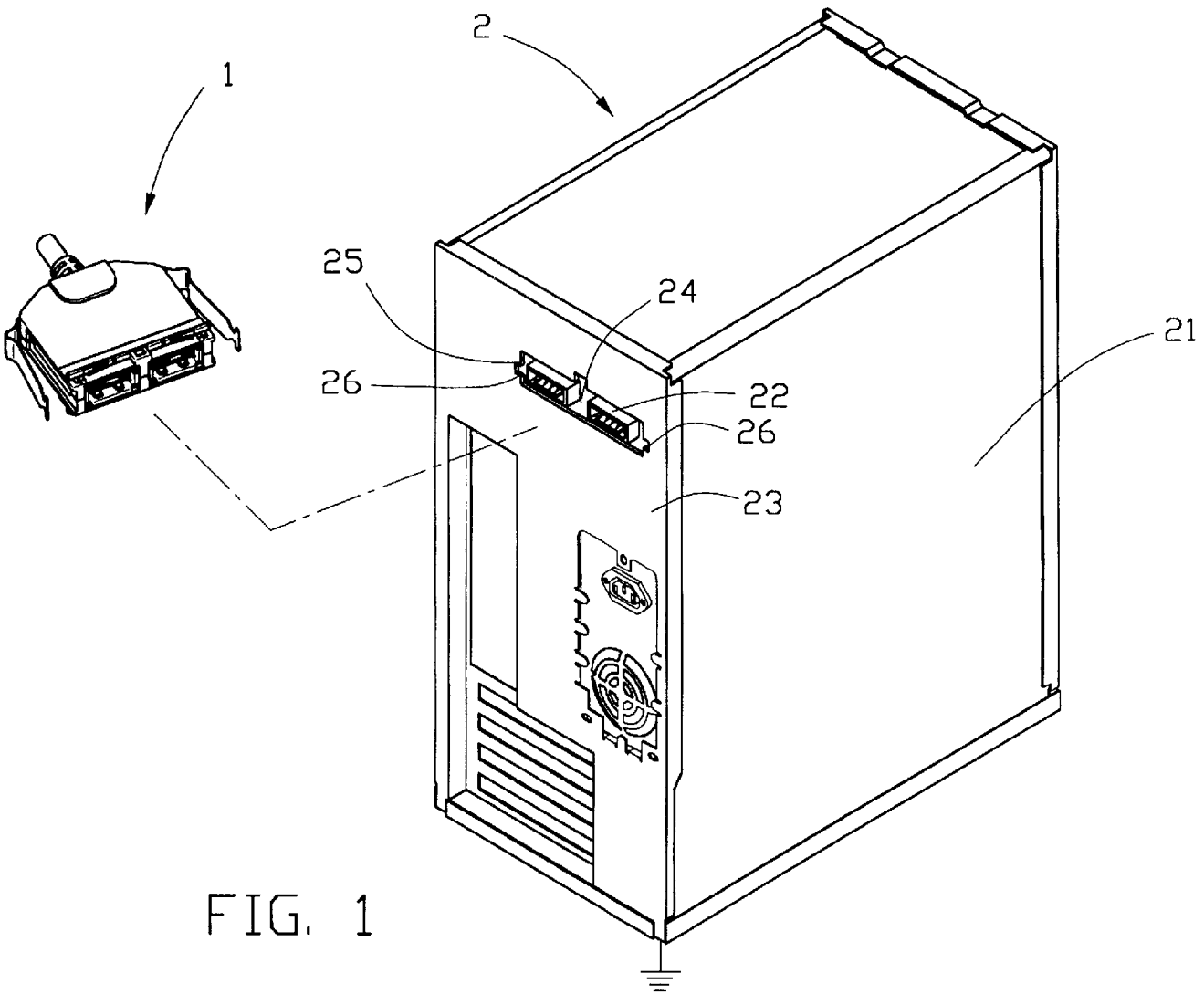
FIG. 1 is a perspective view of a cable connector assembly of the present invention and a host device with which the cable connector assembly is going to mate.
Figure 2:
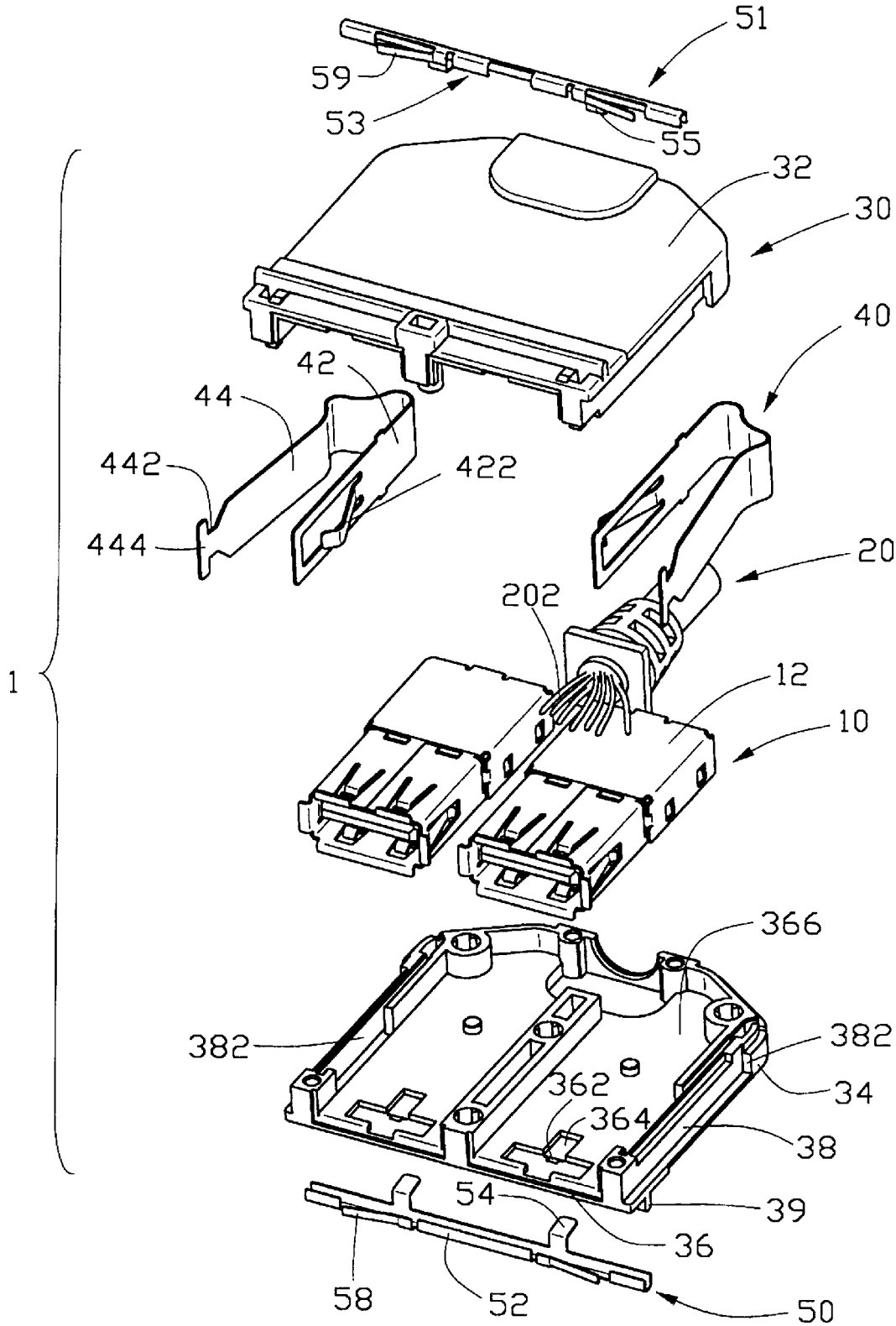
FIG. 2 is an exploded perspective view of the cable connector assembly of the present invention.

Referring to the drawings in detail, and first to FIGS. 1 and 2, a preferred embodiment of the present invention relates to a cable connector assembly 1 that is electrically connected to an electronic apparatus 2, such as a host computer, for transmitting signals between the electronic apparatus and a complementary device. The electronic apparatus 2 comprises a case 21, two first connectors 22 fixedly in the case 21 and a grounded panel 23 mounted to a rear side of the case 21, wherein the grounded panel 23 is electrically connected to a reference grounding potential in a manner known by those skilled in the art. The case 21 and the first connectors 22 are conventional, so details of them are omitted herein for conciseness. The grounded panel 23 defines a lengthwise opening 24 and four blocks 25 are formed adjacent to four corners of the opening 24, respectively. A notch 26 is defined in each opposite lateral side of the opening 24 and between two adjacent blocks 25 such that the cable connector assembly 1 can be reliably attached to the panel 23 of the electronic apparatus 2, as detailed below.

As shown in greater detail in FIG. 2, the cable connector assembly 1 of the present invention comprises a pair of second connectors 10, such as USB connectors, a cable end 20 connecting to the pair of second connectors 10, a cover 30 enclosing the pair of second connectors 10 and the cable end 20 therein, and grounding means comprising a pair of conductive latches 40 and first and second grounding bars 50, 51 partially received in the cover 30, respectively. Each second connector 10 has a shrouded shell 12 generally enclosing an insulative housing and terminals thereof (not labeled) for protecting electronic signals transmitted through the terminals from external electromagnetic interference. The second connectors 10 and the cable end 20 are generally conventional; detailed descriptions of them are, therefore, omitted herein for conciseness.

The cover 30 preferably comprises an upper cover 32 and a lower cover 34 that are combined together by conventional means after elements that are required to be received in the cover 30 are correctly positioned therein. The upper and lower covers 32, 34 are generally structural mirror images of each other. Therefore, only the lower cover 34 is illustrated in great detail hereinafter, and the upper cover 32 may be known by referring to the lower cover 34. The lower cover 34 comprises a body portion 36 and a peripheral wall 38 extending perpendicularly upwards from the body portion 36. The 5 body portion 36 defines a pair of slots 362 at a front portion thereof. A recess 364 is defined adjacent to a rear portion of each slot 362. Each recess 364 is recessed from an inner face 366 of the lower cover 34, and communicates with its adjacent slot 362. The body portion 36 further forms a rib 39 on an outer face thereof. Each peripheral wall 38 defines a channel 382 in each opposite sidewall thereof for retaining the conductive latches 40 therein.

Each conductive latch 40 is generally V-shaped and comprises a first arm 42 and a second arm 44 extending divergently from a common point (not labeled). The first arm 42 forms a spring cantilever 422 deflecting therefrom in a direction away from the second arm 44. The second arm 44 defines a V-cut 442 in each opposite side of a free end 444 thereof.

The first and second grounding bars 50, 51 are structurally similar to each other. Therefore, only the first grounding bar 50 is illustrated in great detail, and the second grounding bar 51 may be known by referring to the first grounding bar 50. The first grounding bar 50 comprises an elongate base portion 52 being generally U-shaped in cross-section. A pair of tabs 54 extend upwardly and then rearwardly from a middle portion of the base portion 52. The tabs 54 are spaced from each other a distance equal to that between the pair of slots 362 of the lower cover 34, thereby enabling the tabs 54 to be properly inserted into the slots 362, respectively. A pair of spring fingers 58 is formed at a front portion of the base portion 52, whereby each spring finger 58 has a free end spaced from the base portion 52 a distance. The two spring fingers 58 project in a forward direction and away from each other.

Figure 3:
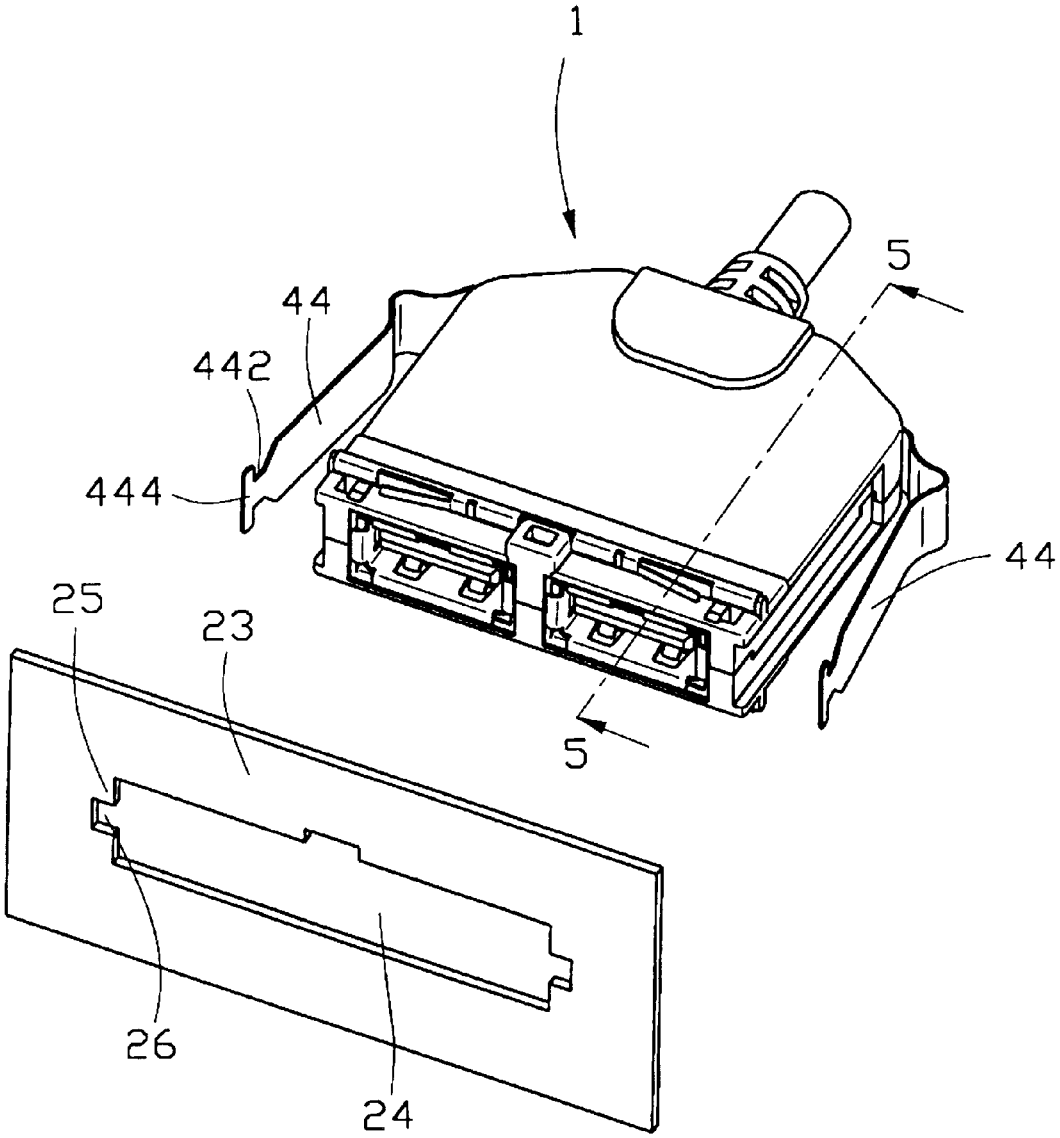
FIG. 3 is a perspective view of the assembled cable connector assembly of FIG. 2 and a part of a grounded panel of the host device of FIG. 1, prior to mating.
Figure 4:
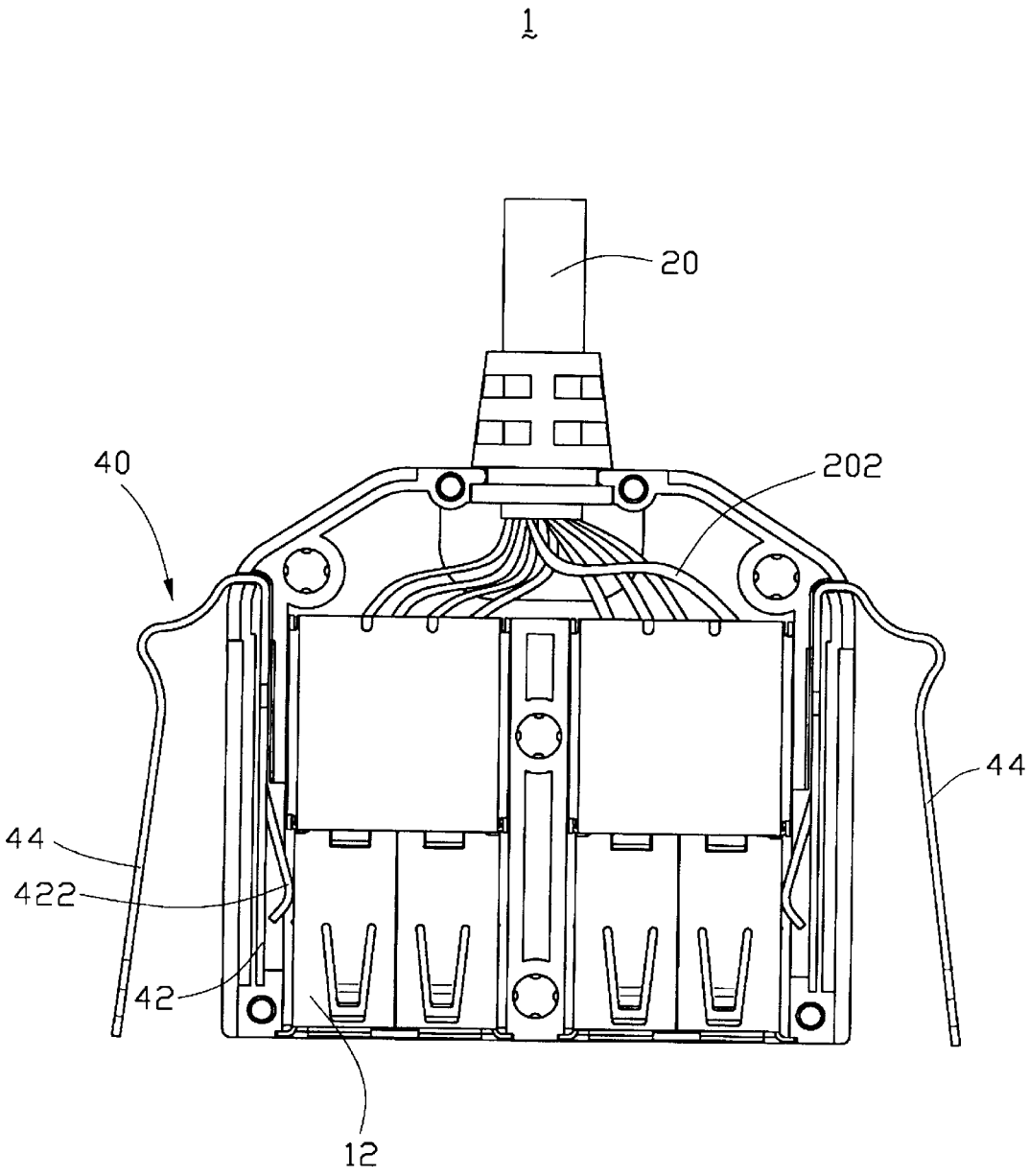
FIG. 4 is an enlarged top planar view of the cable connector assembly, wherein an upper cover of the cable connector assembly is removed therefrom to reveal an inner structure of the cable connector assembly.

Further referring to FIGS. 3 and 4, in assembly, the second and first grounding bars 51, 50 are respectively attached to the upper and lower covers 32, 34. The base portion 52 of the first grounding bar 50 engagably receives the rib 39 of the lower cover 34. The pair of tabs 54 of the first grounding bar 50 extend through the pair of slots 362 into the recesses 364 of the lower cover 34. The second grounding bar 51 is similarly assembled to the upper cover 32. Base portions 52, 53 of each of the first and the second grounding bars 50, 51 are spaced a first distance from a front end of the cable connector assembly 1. Distal ends of spring fingers 58, 59 of each of the first and the second grounding bars 50, 51 are spaced a second distance from the front end of the cable connector assembly 1, whereby the second distance is shorter than the first distance. Tabs 54, 55 are then bent to deflect inward toward a center of the cover 30 from the recesses of the body portions of the upper and the lower covers 32, 34, such that a free end of each tab 54, 55 can resiliently engage with a shrouded shell 12 of a corresponding second connector 10. The cable end 20 is electrically connected to the pair of second connectors 10 by soldering wires 202 of the cable end 20 to terminals (not shown) of the second connectors 10. The pair of second connectors 10 are then positioned side by side on the lower cover 34 such that bottom surfaces of the shrouded shells 12 abut against the free ends of the tabs 54 of the grounding bar 50, respectively. Thus, the shrouded shells 12 are electrically connected together via the first grounding bar 50. The pair of conductive latches 40 are assembled to the lower cover 34 whereby each first arm 42 is engagably received in its corresponding channel 382, and each second arm 44 laterally extend away from the lower cover 34. Each spring cantilever 422 projects inwardly to resiliently abut against an outer lateral side of the shrouded shell 12 of the adjacent second connector 10. The upper cover 32 is then attached to the lower cover 34 by conventional means. Thus, the pair of tabs 55 of the second grounding bar 51 now resiliently engage with top portions of the shrouded shells 12 of the second connectors 10. Accordingly, static charge accumulated on the shrouded shells 12 may be dissipated therefrom through both the first and second grounding bars 50, 51. The completed assembly forms two ports (not labeled), so that the connector assembly 1 can simultaneously connect to the two first connectors 22 of the electronic apparatus 2 (FIG. 1).

Figure 5:
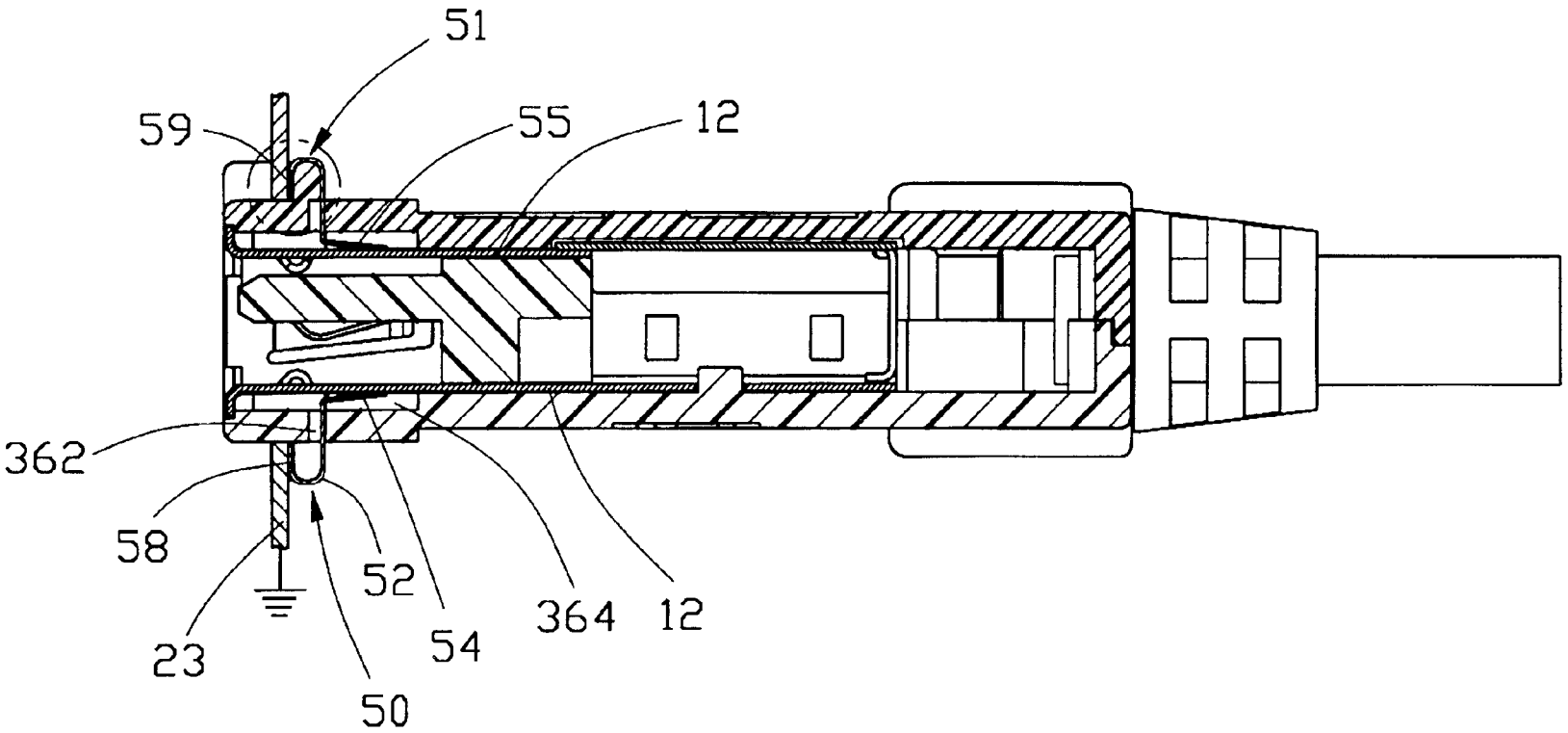
FIG. 5 is a cross-sectional view taken along line 5—5 of FIG. 3 to particularly show a grounding path between conductive shells of the cable connector assembly and the grounded panel of the host device.
Figure 5A:
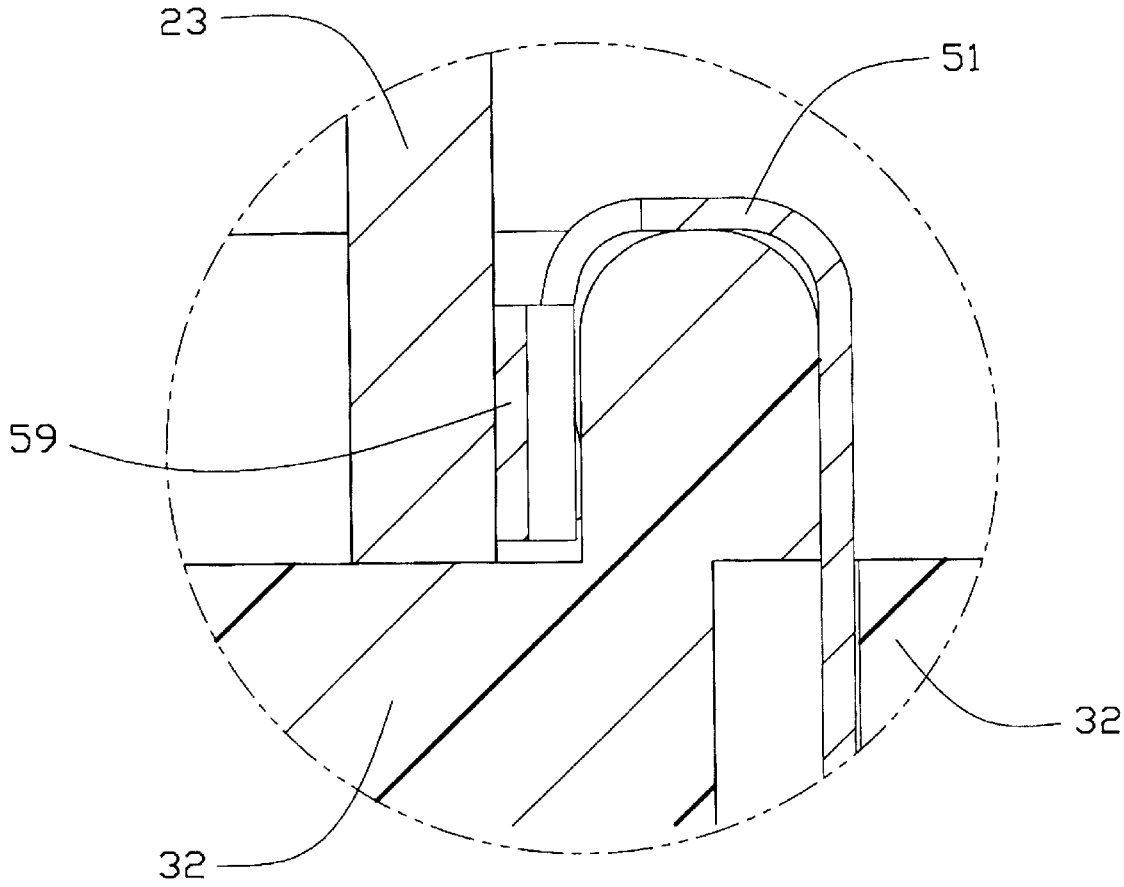
FIG. 5A is an enlarged partial view of FIG. 5, particularly showing electrical connection between the spring fingers of a grounding bar and the grounded panel of the host device.

Referring to FIGS. 3–5, when the cable connector assembly 1 is mated to the two first connectors 22 of the electronic apparatus 2, a front end of the cable connector assembly 1 is inserted through the opening 24 of the grounded panel 23. During insertion, the second arms 44 of the pair of conductive latches 40 are inwardly compressed by external force exerted thereon, such that each free end 444 is able to extend through the opening 24 of the grounded panel 23 between the adjacent first connectors 22 and the adjacent notch 26. After the pair of second connectors 10 respectively mate with the pair of first connectors 22 of the electronic apparatus 2, the external force is removed and the second arms 44 spring back outwardly. The free ends 444 of the second arms 44 are engagably received at inner surfaces of the grounded panel 23, with the V-cuts 442 being engagably received at edges of the blocks 25. This prevents accidental disengagement of the cable connector assembly 1 from the electronic apparatus 2, and also establishes a grounding path between each shrouded shell 12 and the grounded panel 23 of the electronic apparatus 2. The spring fingers 58, 59 (see FIG. 2) of the first and the second grounding bars 50, 51 resiliently press against an outer surface of the grounded panel 23 (see FIG. 5A), whereby reliable electrical connection therebetween is established. Thus, the shrouded shells 12 are electrically connected to the grounded panel 23, which in turn is connected to a reference grounding potential by conventional means when the shrouded shells 12 are connected to the reference grounding potential in this way, no static charge accumulate on the shrouded shells 12, thereby allowing signals to be successfully transmitted through the second connectors 10. The resilient pressing of the spring fingers 58, 59 of the grounding bars 50, 51 against the front surface of the grounded panel 23 provides not only reliable electrical connection, but also a firm mechanical connection between the connector assembly 1 and the panel 23.

The preferred embodiment of the present invention described above comprises a pair of second connectors 10 arranged together side by side. An alternative embodiment of the present invention comprises two second connectors 10 stacked one above the other. In the preferred embodiment and the alternative embodiment, the second connectors 10 are individually formed. However, as is well known by those skilled in the art, a single connector with a housing and a shrouded shell and having a two-port configuration can be used to replace two individual second connectors 10.

Furthermore, as regards any of the above embodiments, the second connectors 10 are grounded to the grounded panel 23 via both the pair of conductive latches 40 and the first and second grounding bars 50, 51. In further alternative embodiments of the present invention, a selected one of the pair of conductive latches 40 and/or a selected one of the first and second grounding bars 50, 51 may be adequate to ground the two second connectors 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted to connect with a complementary connector mounted on a grounded panel of an electronic apparatus, comprising:

at least a connector housing;

a plurality of contacts received in the housing;

at least a conductive shrouded shell enclosing the housing;

a cover enclosing the conductive shrouded shell;

at least a conductive latch having a first arm attached to the cover and in electrical connection with the conductive shrouded shell, and a second arm adapted to latch with the grounded panel of the electronic apparatus and to establish an electrical connection with the grounded panel; and at least a grounding bar having a base portion mounted to an outer surface of the cover and at least a tab extending from the base portion into the cover and electrically engaging with the conductive shrouded shell, the base portion forming at least a spring finger forwardly protruding therefrom and adapted to resiliently press against the grounded panel, whereby electrical connection is established between the conductive shrouded shell and the grounded panel when the connector assembly is mated with the complementary connector;

wherein the base portion of the grounding bar is rearwardly spaced a first distance from a front end of the electrical connector;

wherein the free end of the spring finger of the base portion is forwardly spaced from the base portion a distance such that the free end is closer than the base portion to the front end of the electrical connector;

wherein the first arm comprises a spring cantilever extending toward and connecting with the conductive shrouded shell;

wherein the second arm defines a V-cut in each opposite side of a free end thereof for latching with the grounded panel;

wherein the cover forms at least a rib on an external surface thereof and the base portion of the grounding bar is generally U-shaped in cross-section, the base portion engaging with the rib such that the grounding bar is securely retained on the cover;

wherein the cover defines at least a slot through which the tab of the grounding bar extends.

* * * * *